United States Patent [19]

Davis et al.

[11] Patent Number: 4,973,941

[45] Date of Patent: Nov. 27, 1990

[54] ELECTRONIC SOUND GENERATING DEVICE

[75] Inventors: Louis B. Davis, Gallatin, Mo.; Stephen C. K. Kwok, Kowloon, Hong Kong

[73] Assignee: L. B. Davis, Inc., Gallatin, Mo.

[21] Appl. No.: 419,612

[22] Filed: Oct. 10, 1989

[51] Int. Cl.[5] ..... G08B 3/00

[52] U.S. Cl. ..... 340/384 E; 340/384 R; 381/90; 446/297

[58] Field of Search ..... 340/384 E, 384 R, 401, 340/402; 381/90, 110, 111, 114, 190, 205; 446/297, 397, 404; 200/520, 292

[56] References Cited

U.S. PATENT DOCUMENTS

| | | | |
|---|---|---|---|
| 3,932,868 | 1/1976 | Saitou . | |
| 4,233,679 | 11/1980 | Schwarzchild | 340/384 E |
| 4,547,635 | 10/1985 | Segan et al. | 200/85 R |
| 4,550,429 | 10/1985 | Burbank et al. | 381/90 |
| 4,597,099 | 6/1986 | Sawafuji | 381/90 |
| 4,604,606 | 8/1986 | Sweany . | |
| 4,675,519 | 6/1987 | Price | 446/297 |
| 4,810,997 | 3/1989 | Kudo et al. | 340/384 E |

*Primary Examiner*—Joseph A. Orsino
*Assistant Examiner*—Brent A. Swarthout
*Attorney, Agent, or Firm*—King and Schickli

[57] ABSTRACT

An electronic sound generating device icludes a two-piece housing having a lower casing and a lid. A contact switch, in the form of a conductive rubber cup, is received in the lower casing adjacent a circuit board. Activating contacts on the circuit board face the contact switch. A sound generating element and a touch plate are also received in the lower casing. The touch plate includes a centrally located dome portion that extends through an actuator opening in the lid. The touch plate also includes at least one sound radiating hole. To activate the device, the touch plate is pushed inwardly into the housing. This causes the circuit board, which is capable of limited movement within the housing, to move toward the contact switch. As the activating contacts on the circuit board engage the contact switch, the circuit is completed and the sound generating device is activated.

6 Claims, 2 Drawing Sheets

ELECTRONIC SOUND GENERATING DEVICE

TECHNICAL FIELD

The present invention relates generally to electronic sound generating devices and, more particularly, to sound generating devices that are relatively small in size and adapted to be incorporated into various objects such as stuffed dolls or the like.

BACKGROUND OF THE INVENTION

Small electronic sound generating devices are well known in the art. A state of the art device of this type is disclosed in U.S. Pat. No. 4,810,997 to Kudo et al. The sound generating device disclosed in this patent includes a holding plate that is sandwiched between a cover and a touch plate case. A sound generating device, in the form of a piezoelectric buzzer is retained between the cover and the holding plate and a circuit board is retained between the holding plate and the touch plate case.

The sound generating device disclosed in the Kudo patent is relatively small and rugged. As such it is particularly adapted for incorporating into children's toys such as stuffed dolls. The device is also relatively easy to operate.

It must be appreciated, however, that further improvements to this type of electronic sound generating device are still needed. More particularly, the Kudo sound generating device is still somewhat susceptible to damage as a result of the rough handling to which children often subject their toys. Additionally, the sound generated by the Kudo device is not particularly loud. As such, the Kudo device can only be used in a limited number of stuffed toys where the sound is not muffled to the point of being difficult to hear.

This problem primarily results from the fact that the sound radiates from the Kudo device from the side opposite the touch plate. Since the touch plate must be positioned adjacent a surface of the stuffed animal to allow activation of the device, it must be appreciated that the sound radiating from the rear of the device must travel through the stuffed toy to the other side. Thus, the muffling effect of the stuffed toy is a significant problem that limits the application of the Kudo sound generating device to relatively small and thin stuffed toys.

SUMMARY OF THE INVENTION

Accordingly, it is a primary object of the present invention to provide an improved electronic sound generating device overcoming the above-described limitations and disadvantages of the prior art.

Another object of the present invention is to provide an electronic sound generating device that is small in size and relatively easy to activate so as to be particularly suited for utilization in stuffed toys or the like.

Yet another object of the present invention is to provide an electronic sound generating device exhibiting enhanced durability and overall resistance to shock damage from rough handling.

Still another object of the invention is to provide an electronic sound generating device that produces a louder sound of better quality.

Yet another object of the present invention is to provide an electronic sound generating device wherein the sound is radiated from the front of the device through the touch plate so as to be directed toward the individual activating the device.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved electronic sound generating device is provided. The device includes a protective housing including a lower casing and a lid that may be joined together. The lid also includes an actuator opening. A contact switch is received within the lower casing. Preferably, this switch is mounted to an end wall of the lower casing.

A circuit board is also received within the lower casing adjacent the contact switch. The circuit board includes normally open activating contacts that face the contact switch and allow activation of the sound generating device. A sound generating element and touch plate are also received within the casing. The sound generating element is electrically connected to the circuit board. The touch plate is received within the lower casing adjacent the sound generating element and the lid. The touch plate is engagable through the actuator opening in the lid so as to allow activation of the device.

More particularly, by pushing the touch plate inwardly from the lid toward the lower casing the sound generating element and circuit board are displaced toward the contact switch mounted to the end wall of the lower casing. Once the activating contacts of the circuit board engage the contact switch, the operating circuit is closed and the device begins to generate sounds such as musical melodies. The sounds generated by the sound generating element or piezoelectric buzzer radiate from the device through at least one sound radiating hole provided in the touch plate. Advantageously, since the sound radiates from the touch plate it is typically directed toward the individual depressing the touch plate and activating the device.

More particularly, the touch plate includes a centrally located dome portion. The dome portion extends through the actuator opening in the lid just beyond the outer face of the lid so as to provide ready access to the touch plate and overall ease of activation of the device. Additionally, a series of sound radiating holes may be provided about the periphery of the dome portion at spaced locations. In this manner, the sound generated from the device is radiated in a number of directions so as to provide superior tone and definition.

Still other objects of the present invention will become readily apparent to those skilled in this art from the following description wherein there is shown and described a preferred embodiment of this invention, simply by way of illustration of one of the modes best suited to carry out the invention. As will be realized, the invention is capable of other different embodiments and its several details are capable of modifications in various, obvious aspects all without departing from the invention. Accordingly, the drawing and descriptions will be regarded as illustrative in nature and not as restrictive.

BRIEF DESCRIPTION OF THE DRAWING

The accompanying drawing incorporated in and forming a part of this specification illustrates several aspects of the present invention and together with the description serves to explain the principles of the invention. In the drawing.

Reference will now be made in detail to the present preferred embodiment of the invention an example of which is illustrated in the accompanying drawing.

DETAILED DESCRIPTION OF THE INVENTION

Figure 1:
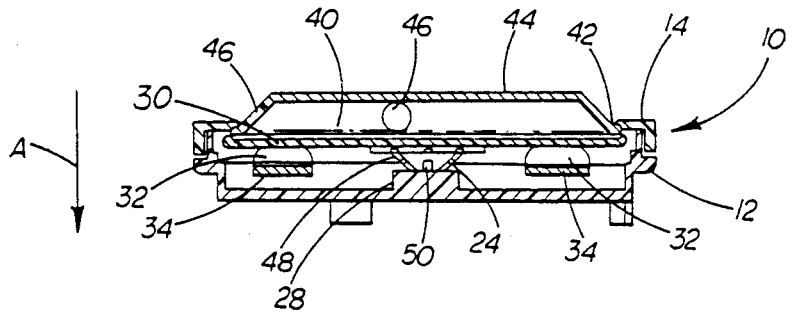
FIG. 1 is a cross-sectional view of the electronic sound generating device of the present invention.
Figure 2:
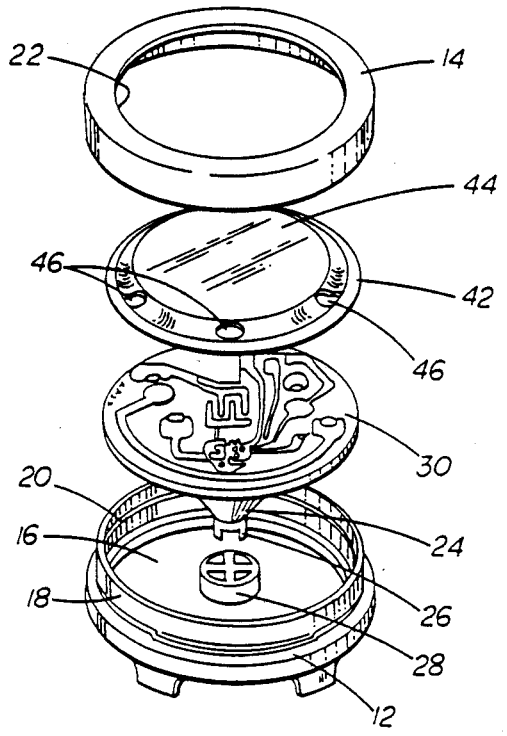
FIG. 2 is an exploded perspective view of the electronic sound generating device shown in FIG. 1.

Reference is now made to the drawing figures and, particularly, FIGS. 1 and 2, showing an electronic sound generating device 10 of the present invention. As shown, the device 10 includes a protective housing comprising a lower casing 12 and a lid 14 that may be joined together. Both the lower casing 12 and lid 14 may be formed of a synthetic resin.

As shown, the lower casing 12 includes a cavity 16 defined by a cylindrical side wall 18 including an annular step 20. The lid 14 includes an actuator opening 22, the function of which will be discussed below.

A contact switch, preferably in the form of a conductive rubber cup 24 is received within the lower casing 12. As shown, the conductive rubber cup 24 may include a series of downwardly projecting lugs 26 adapted to engage within a mounting socket 28 molded to the end wall of the lower casing 12. Of course, alternative mounting structures could be utilized.

Figure 3:
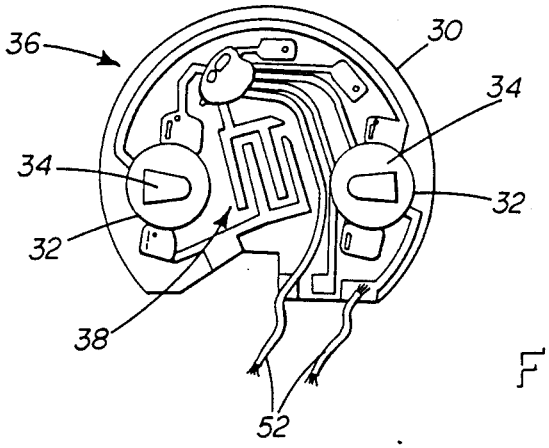
FIG. 3 is a plan view of the circuit board of the sound generating device shown in FIG. 1.
Figure 4:
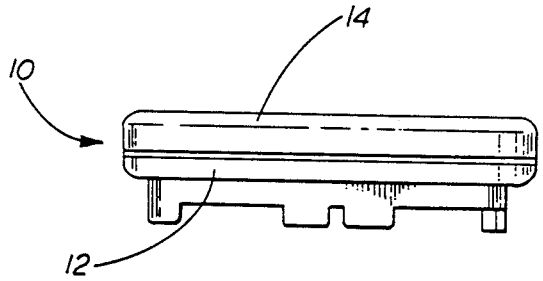
FIG. 4 is a side elevational view of the sound generating device.

A circuit board 30 is also received within the lower casing adjacent the conductive rubber cup contact switch 24. The circuit board 30 includes a circuit on one side as shown in FIG. 3. As shown, the circuit includes a pair of batteries 32 held in battery holders 34 and an electronic component 36 for controlling the generation of sound. Additionally, circuit board 30 includes activating contacts 38. As shown in FIGS. 1 and 2, with the sound generating device 10 assembled the activating contacts 38 of the circuit board 30 are adjacent to and face the conductive rubber cup contact switch 24.

A sound generating element, in the form of a piezoelectric buzzer 40 and a touch plate 42 are also received within the lower casing 12. Preferably, the sound generating element 40 is attached to the touch plate 42. Where the touch plate 42 is formed of resilient material, this may be accomplished by snapping the outer peripheral edge of the sound generating element 40 into an internal mounting groove provided in the touch plate. Alternatively, where the touch plate 42 is formed from metal, the outer periphery of the touch plate may be rolled around the outer peripheral edge of the sound generating element 40 to complete the attachment.

In order to provide improved tone and brilliance, it is preferred that the touch plate 42 be formed of metal such as aluminum. As shown, when fully assembled the touch plate 42 is positioned in the lower casing 12 between the sound generating element 40 and the casing lid 14. Further, it should be appreciated that the touch plate 42 includes a centrally located dome portion 44 which extends upwardly from the sound generating element 40 through the actuator opening 22 in the lid 14. For ease of activation the dome portion 44 may in fact extend outwardly just beyond the outer face of the lid 14.

Figure 5:
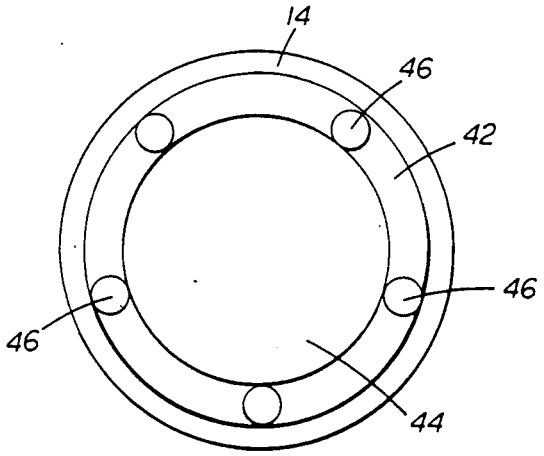
FIG. 5 is a top plan view of the sound generating device.

The touch plate 42 also includes at least one and preferably a series of sound radiating openings 46. As best shown in FIGS. 2 and 5, the openings 46 are preferably provided along the periphery of the dome portion 44 at spaced locations so as to allow sound to be radiated over a wider area in several directions. In this way a better distribution of the sound from the sound generating device is possible.

As shown in FIG. 1, the assembled device 10 may be easily activated. More particularly, when the touch plate 42 is depressed in the direction of action arrow A toward the lower casing 12, the sound generating element 40 is similarly displaced. The sound generating element 40 engages the circuit board 30 which is also displaced in a like manner toward the end wall of the casing 12. As the circuit board 30 is displaced it presses against the upper lip 48 of the conductive rubber cup contact switch 24. This upper lip 48 folds back until the activating contacts 38 on the lower side of the circuit board 30 engage the conductive contact 50 positioned within the base of the cup 24. Once this occurs, the circuit across the activating contacts 38 is closed and sound generation is activated.

More particularly, the electronic component 36 receives power from the batteries 32 and controls the operation of the piezoelectric sound generating element 40 through the conducters 52. The sound generated by the element 40 is directed outwardly from the front of the device 10 through the sound radiating openings 46 in the touch plate 42. Advantageously, since the touch plate 42 is generally positioned within a stuffed animal or other object adjacent to the surface so as to allow ease of activation, the sound produced is directed directly back toward the operator through that surface. Thus, clear, crisp sound is produced. In contrast, electronic sound generating devices of the prior art have typically included sound radiating holes at the rear of the device in the lower casing so that the sound is directed away from the individual activating the device and into the body of the stuffed animal. Accordingly, the sound must travel through the stuffed animal and it typically becomes muffled and unclear.

It should also be appreciated that the device of the present invention exhibits unmatched durability. This is a particularly important aspect of the present invention when the rough handling stuffed toys equipped with this device receive from children is considered. More particularly, it should be appreciated that the sound generating element 40 and circuit board 30 are adapted for free-floating movement within the lower casing 12. The free-floating movement is only limited on one side by engagement with the annular step 20 and on the other side by engagement with the lid 14. Any movement of the sound generating element 40 and circuit board 30 is, however, also cushioned by the resilient upper lip 48 of the conductive rubber cup 24. Because of the cushioning effect, shock damage from any sudden jarring motions which may be experienced is substantially eliminated.

In summary, numerous benefits have been described which result from employing the concepts of the present invention. Advantageously, the electronic sound generating device 10 of the present invention directs sound back through the front face of the device through the sound radiating openings 46 in the touch plate 42. In this way, the sound is directed back toward the individual activating the device rather than rearwardly into the stuffed animal or other object in which the device is retained. As such, the sound is clearer and louder. Additionally, due to the metal construction of the touch plate 42, the tonal qualities and brilliance of the sound are enhanced.

As also discussed, the device provides more reliable operation as the circuit board 30 abuts the conductive rubber cup 24. In this way, sudden movements of the board 30 caused either by excessive pressure to the touch plate 44 when activating the device or by sudden jarring movements are cushioned. As such, the overall reliability of the device is greatly increased.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. An electronic sound generating device, comprising:

a protective housing including a lower casing and a lid that may be joined together, said lid also including an actuator opening:

a contact switch received within said lower casing;

a circuit board received within said lower casing adjacent said contact switch, said circuit board including activating contacts facing said contact switch;

a touch plate received within said lower casing adjacent said lid, said touch plate being engageable through said actuator opening in said lid and including at least one sound radiating opening; and a sound generating element received within said lower casing adjacent said touch plate and electrically connected to said circuit board, whereby depression of said touch plate causes downward movement of said circuit board into contact with said contact switch, thereby activating said sound generating element.

2. The electronic sound generating device set forth in claim 1, wherein said contact switch is mounted to said lower casing.

3. The electronic sound generating device in claim 1, wherein said sound generating element and said touch plate are attached together.

4. The electronic sound generating device in claim 1, wherein said touch plate includes a centrally located dome portion that extends through said actuator opening in said lid, a series of sound radiating openings being provided about the periphery of said dome portion at spaced locations.

5. The electronic sound generating device in claim 4, wherein said dome portion extends outwardly just beyond an outer face of said lid so as to provide ready access to said touch plate for ease of actuation.

6. An electronic sound generating device, comprising:

a protective housing including a lower casing and a lid that may be joined together, said lid also including an actuator opening;

a circuit board received within said lower casing, said circuit board including activating contacts;

a contact switch received within said lower casing adjacent said circuit board and facing said activating contacts, said contact switch including a conductive rubber cup designed to engage said circuit board and cushion said circuit board from shock damage;

a sound generating element received within said lower casing and electrically connected to said circuit board; and a touch plate received within said lower casing adjacent said lid, said touch plate being engageable through said actuator opening in said lid and including at least one sound radiating opening, whereby depression of said touch plate causes downward movement of said circuit board into contact with said contact switch, thereby activating said sound generating element.

* * * * *